United States Patent [19]

Rogers, Jr.

[11] Patent Number: 4,494,793

[45] Date of Patent: Jan. 22, 1985

[54] TRIGGER RELEASE MECHANISM FOR RECLINING CHAIR

[75] Inventor: Walter C. Rogers, Jr., Denton, N.C.

[73] Assignee: Parma Corporation, Denton, N.C.

[21] Appl. No.: 419,156

[22] Filed: Sep. 17, 1982

[51] Int. Cl.[3] ..... A47C 1/02

[52] U.S. Cl. ..... 297/85; 297/379; 297/269

[58] Field of Search ..... 297/85, 353, 358, 359, 297/379, 269, 271; D8/308, 88; 74/519

[56] References Cited

U.S. PATENT DOCUMENTS

| | | | |
|---|---|---|---|
| 1,344,123 | 6/1920 | Griffiths | 74/519 |
| 2,624,613 | 1/1953 | Parmely | 297/379 |
| 2,776,702 | 1/1957 | Belisle | 297/269 |
| 2,833,336 | 5/1958 | McGregor | 297/379 X |
| 3,055,706 | 9/1962 | Van Der Meek et al. | 297/358 |
| 3,475,051 | 10/1969 | Crawford | 297/85 |
| 3,730,585 | 5/1973 | Rogers, Jr. et al. | 297/85 |
| 3,778,103 | 12/1973 | Edwards | 297/359 X |
| 3,904,240 | 9/1975 | Rogers, Jr. et al. | 297/85 |

*Primary Examiner*—William E. Lyddane
*Assistant Examiner*—Peter A. Aschenbrenner
*Attorney, Agent, or Firm*—William E. Mouzavires

[57] ABSTRACT

A trigger release mechanism is provided for a reclining chair especially of the type which is locked in a normal or closed position but which will automatically move into a reclining TV position upon release of a lock mechanism. The trigger release mechanism includes a small lever or trigger mounted on one side of the chair to be conveniently engaged by the chair occupant. A connecting member such as a cable depends from the trigger and is connected to the lock mechanism to actuate it to permit the chair to move to the TV position wherein the footrest is extended.

13 Claims, 7 Drawing Figures

FIG. 5
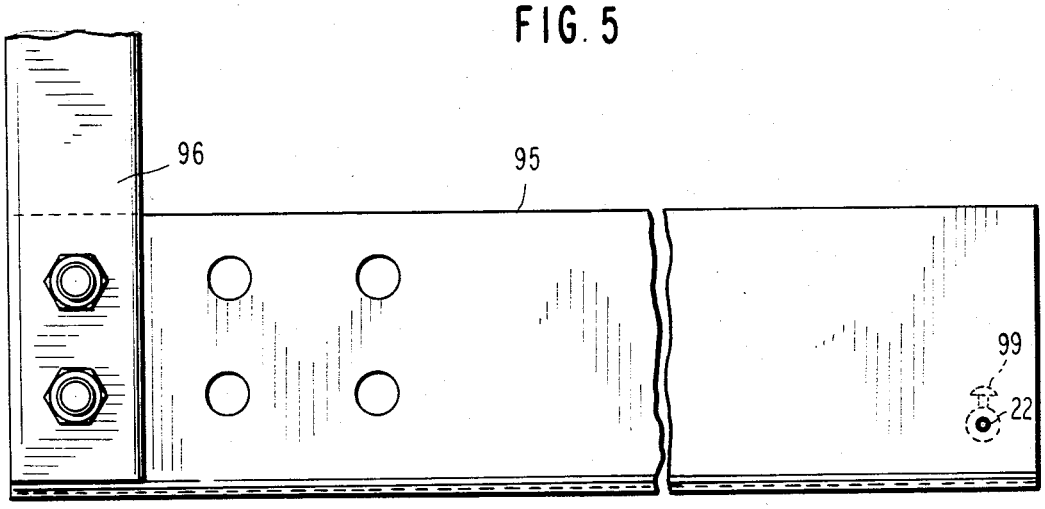
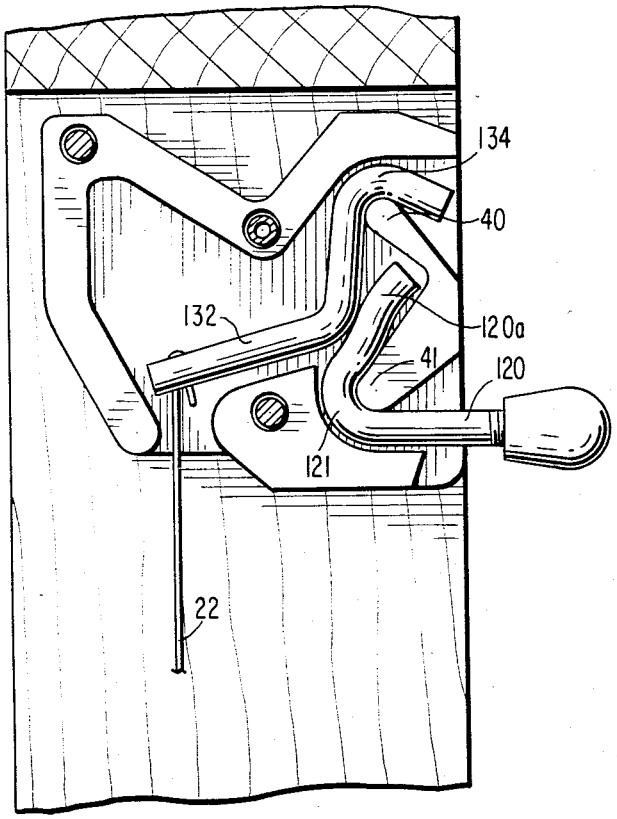
FIG. 6
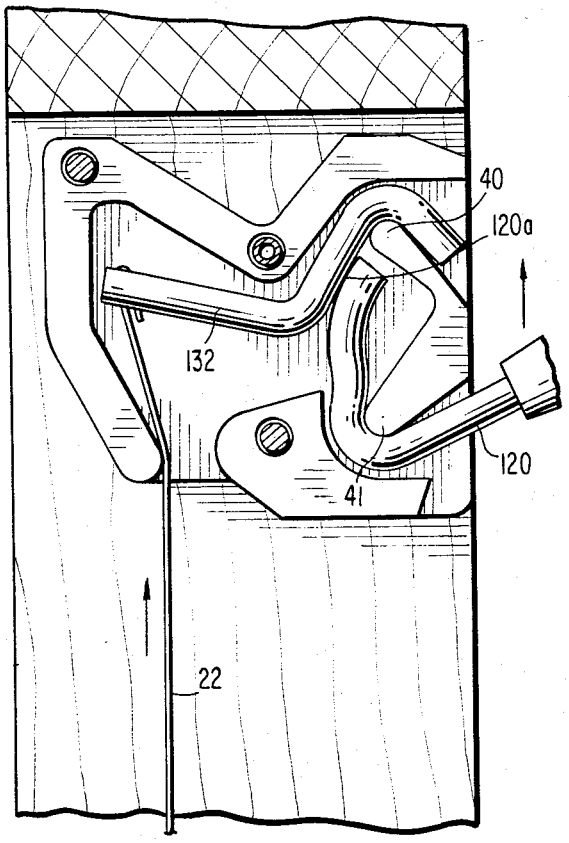
FIG. 7

TRIGGER RELEASE MECHANISM FOR RECLINING CHAIR

BACKGROUND OF INVENTION

In the art of reclining chairs, it is conventional to utilize a hand-operated member or handle to drive a mechanism for moving the chair to TV position wherein the footrest is extended from the front of the chair. In some more recent recliners, such as for example, disclosed in my co-pending U.S. application Ser. No. 06/199,595 filed Oct. 22, 1980, the handle is employed to release a lock mechanism which permits the chair to be moved to TV position automatically by gravity acting on a linkage mechanism. Because of the position of the actuating linkage, it is common to place the handle low on one side of the chair requiring the chair occupant to reach down alongside of the chair to grasp the handle.

In some cases, the handle is therefore designed with a certain length to facilitate its handling by the chair occupant. Additionally, the handle is designed to provide the desired leverage in cases where the linkage mechanism must be driven at least partially, through the use of the handle. In some circles, it is thought that a long handle positioned low on one side of the chair detracts from the appearance of the chair. Another problem which arises in some designs is that the handle upsets the surrounding upholstery upon movement of the handle, rendering the upholstery around the handle unsightly or subject to wear.

OBJECTS OF THE PRESENT INVENTION

It is an object of the present invention to provide a finger-operated trigger release mechanism for a reclining chair which is extremely compact and unobtrusive to the eye and yet may be positioned in a convenient, relatively high position on one side of the chair to facilitate actuation by the chair occupant.

Another object of the present invention is to provide such a trigger release mechanism which requires a very small aperture through the upholstery to accommodate it and will not upset or tear the upholstery during its movement.

A further object of the present invention is to provide such a trigger release mechanism that may be economically manufactured as a small compact unit and easily installed into new or existing reclining chair mechanisms.

SUMMARY OF PREFERRED EMBODIMENTS OF THE INVENTION

One preferred embodiment of the trigger release mechanism of the present invention includes a case in which a trigger is mounted for pivotal movement. The case is fixed to a frame portion of the chair with the trigger projecting a small distance through the upholstery. Depending from the trigger within the chair where it is concealed from view, is a connecting member such as a cable, the lower end of which is secured to an arm which in turn is secured to a link included in a lock mechanism such as, for example, disclosed in my aforementioned U.S. application Ser. No. 06/199,595.

When the chair occupant desires to move a chair from the closed or normal generally upright position to the TV position wherein the footrest is extended, the occupant merely has to depress the trigger which may be located conveniently just below the top of the armrest on one side of the chair. This causes the cable to move upwardly, thereby pivoting the arm which in turn pivots the link of the locking mechanism to release the lock mechanism thereby permitting the footrest to move to the extended position. When the chair is returned to the normal or closed position, the trigger mechanism is automatically reset by the reverse action of the parts.

The present invention also includes a novel case and trigger construction for facilitating application of the invention to new or existing recliner chair mechanisms.

In a second preferred embodiment of the invention, the trigger is pivoted upwardly rather than downwardly in order to move the footrest to the extended position.

DRAWINGS

Other objects and advantages of the present invention will become apparent from the following detailed description taken in conjunction with the attached drawings, in which:

FIG. 5 is a plan view of a part included in the mechanism of the present invention; and FIGS. 6 and 7 are views generally similar to FIGS. 2 and 4 respectively but disclosing another embodiment of the present invention.

DETAILED DESCRIPTION

Figure 1:
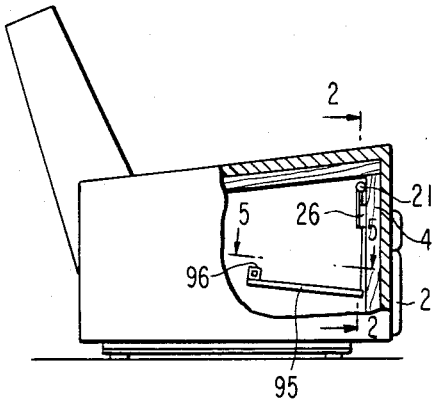
FIG. 1 is a side elevational view of a recliner chair incorporating the trigger release mechanism of the present invention and shown with portions removed to reveal internal parts thereof.

Referring now to the drawings in detail, there is shown in FIG. 1 a reclining chair which typically includes a footrest 2 movable at the front of the chair between a retracted position when the chair is in its normal or closed, generally upright position; and an extended position when the chair is in the so-called "TV position". For purposes of disclosing the present invention, the chair may be of the type disclosed in my co-pending U.S. application Ser. No. 06/199,595 whose disclosure is hereby incorporated by reference into the present application to the extent that such is necessary. In this chair, a footrest is moved to the extended position by the weight of the chair occupant when a lock mechanism is released. In the closed or upright position of the chair, the lock mechanism prevents movement of the chair linkage. However, once the lock mechanism is released through means of a handle, the chair linkage is automatically urged by gravity including the weight of the chair occupant, to the TV position. Such a chair may incorporate a trigger-release mechanism of the present invention for releasing the lock mechanism to allow the chair to move to the TV position.

In the preferred embodiment of the invention disclosed in FIGS. 1 through 5, the trigger release mechanism basically includes a trigger in the form of a small lever 20, a connecting member 22 which may be in the form of a steel cable, and a bracket arm 95 whose one end is fixed to a drive member 96 for releasing the lock mechanism when the trigger is depressed causing the connecting member 22 to move upwardly which in turn pivots the bracket arm 95 in a counterclockwise direction as viewed in the drawings to cause the drive member 96 to rotate. The latter opens the lock mechanism thus releasing the linkage to move to TV position.

In the preferred embodiment, the trigger release mechanism includes a case generally designated 26 which is mounted internally of the chair against an upper portion of a vertical frame member 4 of the chair as shown in FIG. 1. Case 26 includes a flat base wall 28 having apertures 34 formed therein for securing with screws the base 28 against the frame member 4. Along the marginal portions of the base 28 there projects wall portions 29; and engaged on the wall portions 29 is a flat cover plate 30; the latter being achieved through one or more apertures 32 in wall portions 29. It will therefore be seen that when mounted to the frame member 4 of the chair, the case will lie in a plane generally perpendicular to the plane of the side of the chair.

Figure 2:
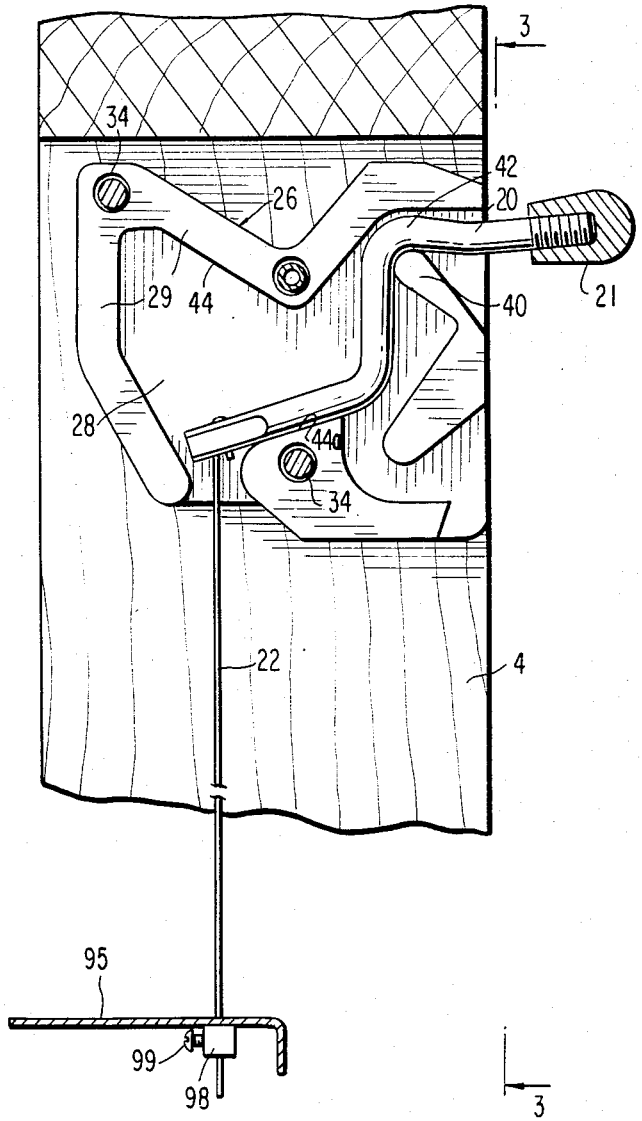
FIG. 2 is a cross-sectional view taken generally along line 2—2 of FIG. 1 but enlarged in size.
Figure 3:
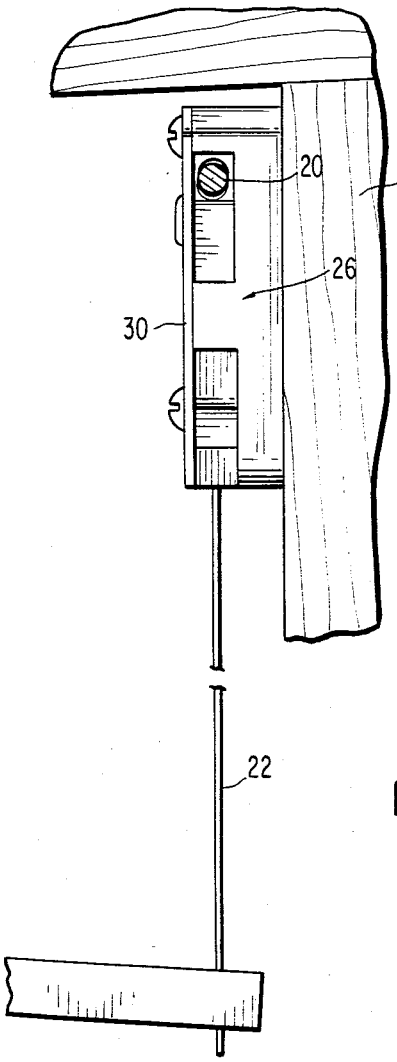
FIG. 3 is a cross-sectional view taken generally along line 3—3 of FIG. 2.
Figure 4:
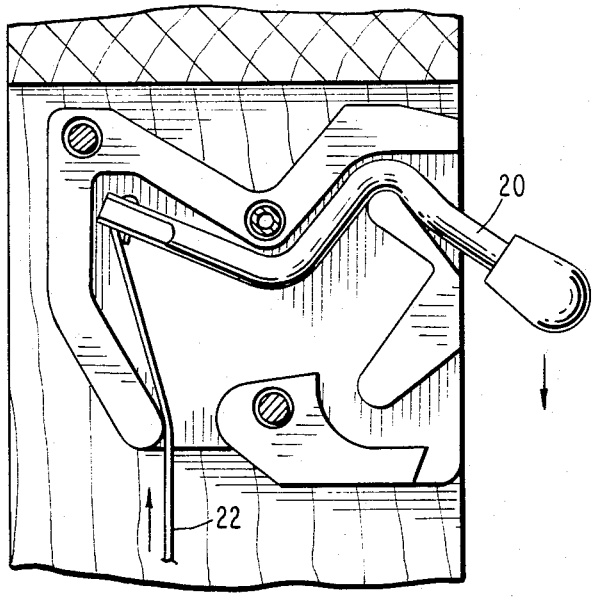
FIG. 4 is a view generally similar to FIG. 2 but with the parts in another position.

Within the case there is pivotally mounted the trigger 20 which in the preferred embodiment may be made from a steel rod which is bent to provide a bite portion 42. Fixed to and upstanding from the base wall 28 of the case in a fulcrum 40 about which the bite portion 42 of trigger 20 is mounted so that the trigger 20 is free to pivot around the fulcrum 40. Note that the trigger 20 projects through the front of the case and an opening in the upholstery is provided with a small knob 21 for handling by the chair occupant. The trigger thus extends generally at right angles to the plane of the side of the chair. As shown in FIG. 2, the cable connecting member 22 extends through a bottom aperture in the case and is fixed to the internal extremity of the trigger 20 so that when the trigger is pivoted downwardly from the position shown in FIG. 2 to the position shown in FIG. 4, cable connecting member 22 will be tensioned and caused to move upwardly for pivoting the bracket arm 95 which in turn will actuate the drive member 96 to release the associated lock mechanism thereby allowing the footrest 2 to move into the extended position. The lowermost position of the trigger 20 may be defined by a stop 44 which is formed by a wall portion projecting from the base 28 to be engageable with the internal extremity 43 of the trigger 20. The uppermost position of the trigger 20 is defined by stop **44*a* which is incorporated in the wall portion 29 to engage the internal extremity 43 of stop 20 as shown in FIG. 2**.

As shown in FIG. 5, the bracket arm 95 may be fixed relative to the cable in any suitable manner such as, for example, the connector generally designated 98 having an aperture which receives the connecting cable 22 and one or more set screws 99 for securing the cable 22 to the connector 98. As shown in FIG. 5, the bracket arm may be provided with a plurality of apertures 90 for securing it to the drive member 96 at the desired position along the bracket arm 95 depending on the requirements of the mechanism so that upon pivoting of the bracket arm 95, the drive member 96 will rotate.

Preferably the case is made from injected molded polypropelene with the base wall 28, standing wall portions 29 including the stops 43 and 44 molded as an integral unit. Cover plate 30 may be made from any suitable plastic or metallic material. It will be appreciated that other materials may also be utilized as desired.

To review operation of the mechanism, and assuming that the chair is in the closed, generally upright position, it will be seen that the trigger 20 will be in its uppermost position shown in FIG. 2. If it is desired to move the chair to the TV position, the occupant merely has to engage the trigger knob 21 with his fingers and pivot it downwardly with the slightest effort which will cause the bite portion 42 of the trigger 20 to pivot around the fulcrum 40 causing the internal extremity 43 of the trigger to rise away from the stop 46. The latter of course, will cause the cable connecting member 22 to rise to pivot the bracket arm 95 which in turn will release the lock mechanism causing the footrest to be projected into the extended position. When the footrest is returned to its retracted position, for example by the chair occupant engaging the footrest with his legs and applying pressure on the footrest to return it, the drive member 96 will rotate in the opposite direction returning the bracket arm 95 to the normal position which in turn will cause the cable connecting member 22 to move downwardly until the trigger engages the upper stop **44*a* as shown in FIG. 2**. The trigger is thus automatically reset for the next operation.

Should it be desired to utilize the trigger-release mechanism of the present invention with a trigger that is moved upwardly rather than downwardly for purposes of releasing the associated lock mechanism, the preferred embodiment shown in FIGS. 6 and 7 may be utilized. In this embodiment, the trigger 120 is mounted about a fulcrum 41 which, in the preferred embodiment, is formed by an integral projection from the base wall 28 of the case. Trigger 120 is formed with a bite portion 121 to be received about the fulcrum 41 as shown in FIGS. 6 and 7.

In addition, a stop member generally designated 132 is provided with the case to be engageable with the portion **120*a* of the trigger 120. Stop member 132 is formed with a bite portion 134 which is mounted about a second fulcrum 40 located above the first fulcrum 41. Stop member 132 is connected at its inner end to cable 22** to drive the same.

In the normal or closed, generally upright position, of the chair, trigger 120 will assume the position generally shown in FIG. 6. In order to move the chair to the TV position, trigger 120 is pivoted upwardly with its bite portion 121 moving about the fulcrum 41. This will cause stop member 132 to be pivoted upwardly with its bite portion 134 moving about fulcrum 40. When the footrest is returned to its retracted position, the trigger will move to its original position shown in FIG. 6. It should be noted that in the presently described embodiment, the case may be identical to the case described above in FIGS. 1 to 5.

What is claimed is:

1. In a reclining chair of the type including a footrest movable between retracted and extended positions, and actuating means for moving the footrest between said retracted and extended positions, the improvement comprising a trigger projecting from one side of the chair, a connecting member connected to the trigger and extending generally vertically from the trigger to a lower level of the chair, an arm connected to the lower end portion of the connecting member and being operatively connected to said actuating means for controlling the actuating means to move the footrest to said extended position, a case fixed to a frame portion of the chair, and means within the case mounting said trigger for pivotal movement, said case including a base having fixed thereon a fulcrum and wherein the trigger has a bite portion positioned about the fulcrum such that the trigger is movable about the fulcrum.

2. The improvement defined in claim 1 wherein said trigger is movable between a first position when the footrest is retracted and a second position when the footrest is extended, and wherein there is included means for returning said trigger to said first position when the footrest is moved to its retracted position.

3. The improvement defined in claim 1 applied to a reclining chair having opposite sides, and wherein said trigger projects generally at right angles to a plane generally parallel to one of the sides of the chair.

4. The improvement defined in claim 1 wherein said connecting member is a cable that is tensioned between the trigger and said arm when the trigger is moved to extend the footrest.

5. The improvement defined in claim 1 wherein said case generally extends at right angles to a plane parallel to one side of the chair.

6. The improvement defined in claim 1 wherein said case includes stop means for limiting movement of the trigger in opposite extreme positions.

7. The improvement defined in claim 6 wherein said stop means includes a stop member movable in the case and engageable by the trigger, and stops positioned in the case to be engageable by the stop member.

8. The improvement defined in claim 7 wherein said case includes a second fulcrum and said stop member includes a bite portion mounted about the second fulcrum to be movable about the second fulcrum.

9. The improvement defined in claim 6 wherein said base including the fulcrum and stop means is molded as an integral one-piece member.

10. The improvement defined in claim 1 wherein said case includes a cover fixed to the base over the trigger to contain the trigger in the case.

11. The improvement defined in claim 10 wherein said base has stops therein engageable with the trigger in opposite extreme positions thereof.

12. The improvement defined in claim 11 wherein said case includes an aperture through which the trigger projects between the base and cover.

13. The improvement defined in claim 12 applied to a chair having one side with an aperture therein through which the trigger extends.

* * * * *